United States Patent [19]

Cram et al.

[11] 3,993,132

[45] Nov. 23, 1976

[54] THERMAL RECOVERY OF HYDROCARBONS FROM TAR SANDS

[75] Inventors: Phillip J. Cram, Calgary; David A. Redford, Fort Saskatchewan, both of Canada

[73] Assignee: Texaco Exploration Canada Ltd., Canada

[22] Filed: June 18, 1975

[21] Appl. No.: 588,124

[52] U.S. Cl. ..... 166/261; 166/272

[51] Int. Cl.[2] ..... E21B 43/24

[58] Field of Search ..... 166/272, 261, 256

[56] References Cited

UNITED STATES PATENTS

| | | | |
|---|---|---|---|
| 2,173,556 | 9/1939 | Hixon | 166/272 |
| 2,818,117 | 12/1957 | Koch | 166/256 |
| 3,171,479 | 3/1965 | Parrish et al. | 166/261 |
| 3,196,945 | 7/1965 | Craig, Jr. et al. | 166/261 |
| 3,411,578 | 11/1968 | Holmes | 166/256 |
| 3,448,807 | 6/1969 | Strickland, Jr. | 166/256 |
| 3,483,924 | 12/1969 | Blevins et al. | 166/272 |
| 3,512,585 | 5/1970 | Allen | 166/272 X |
| 3,587,739 | 6/1971 | Parker | 166/272 X |

*Primary Examiner*—Stephen J. Novosad
*Assistant Examiner*—George A. Suckfield
*Attorney, Agent, or Firm*—Thomas H. Whaley; Carl G. Ries; Charles L. Bauer

[57] ABSTRACT

A method for the recovery of low API gravity viscous oils or bitumen from a subterranean formation by the injection of a mixture of an oxygen-containing gas and steam having an optimum gas/steam ratio that is decreased as the cumulative amount of steam is increased.

10 Claims, 1 Drawing Figure

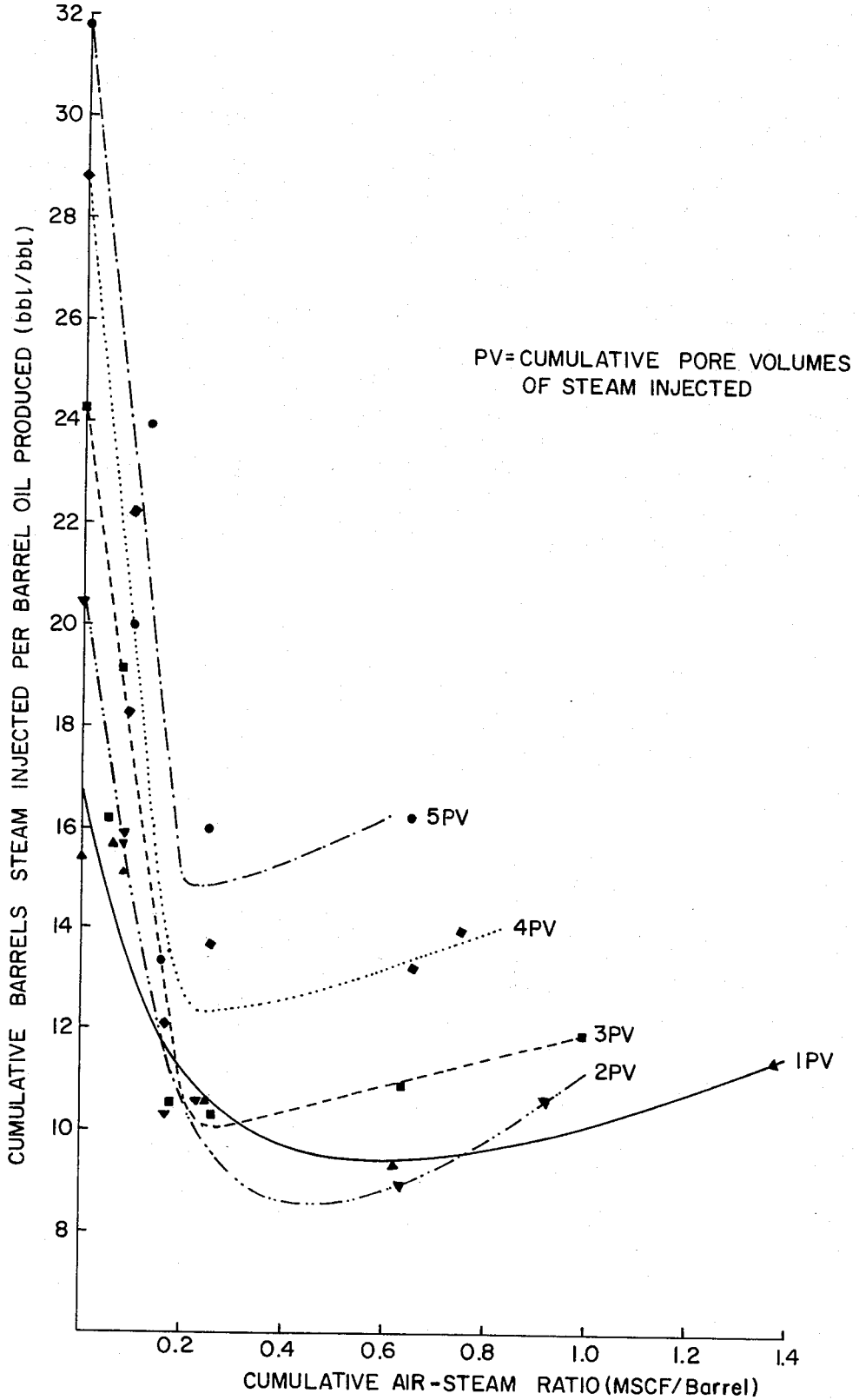
PV=CUMULATIVE PORE VOLUMES OF STEAM INJECTED
5PV
4PV
3PV
2PV
1PV
CUMULATIVE BARRELS STEAM INJECTED PER BARREL OIL PRODUCED (bbl/bbl)
CUMULATIVE AIR-STEAM RATIO (MSCF/Barrel)
32
30
28
26
24
22
20
18
16
14
12
10
8
0.2
0.4
0.6
0.8
1.0
1.2
1.4

THERMAL RECOVERY OF HYDROCARBONS FROM TAR SANDS

BACKGROUND OF THE INVENTION

The present invention relates to an improved method for the recovery of oil from subterranean hydrocarbon-bearing formations containing low API gravity viscous oils or bitumen. More particularly, the invention relates to the production of bitumen and hydrocarbons from reservoirs of low mobility, such as tar sand formations.

The recovery of viscous oils from formations and bitumen from tar sands has generally been difficult. Although some improvement has been realized in stimulating recovery of heavy oils, i.e., oils having an API gravity in the range of 10° to 25° API, little, if any, success has been realized in recovering bitumen from tar sands. Bitumen can be regarded as highly viscous oils having a gravity in the range of about 5° to 10° API and contained in an essentially unconsolidated sand referred to as tar sands.

Vast quantities of tar sands are known to exist in the Athabasca region of Alberta, Canada. While these deposits are estimated to contain several hundred billion barrels of oil or bitumen, recovery therefrom using conventional in-situ techniques has not been too successful. The reasons for the lack of success relate principally to the fact that the bitumen is extremely viscous at the temperature of the formation, with consequent low mobility. The viscosity of the tar sands from the Athabasca deposits, for example, is in the range of several million centipoise at the average formation temperature of about 40° F, so that the bitumen is essentially immobile at formation temperature. In addition, these tar sand formations have very low permeability, despite the fact they are unconsolidated.

Since it is known that the viscosity of oil decreases markedly with an increase in temperature, thereby improving its mobility, thermal recovery techniques have been investigated for recovery of bitumen from tar sands. These thermal recovery methods generally include steam injection, hot water injection and in-situ combustion.

Typically, such thermal techniques employ an injection well and a production well traversing the oil-bearing or tar sand formation. In a steam operation employing two wells, steam is introduced into the formation through the injection well. Upon entering the formation, the heat transferred by the hot fluid functions to lower the viscosity of oil, thereby improving its mobility, while the flow of the hot fluid functions to drive the oil toward the production well from which it is produced.

In the conventional forward in-situ combustion operation, an oxygen-containing gas, such as air, is introduced into the formation via a well, and combustion of the in-place crude adjacent the wellbore is initiated by one of many known means, such as the use of a downhole gas-fired heater or downhole electric heater or chemical means. Thereafter, the injection of the oxygen-containing gas is continued so as to maintain a combustion front which is formed and to drive the front through the formation toward the production well.

As the combustion front advances through the formation, a swept area consisting, ideally, of a clean sand matrix is created behind the front. Ahead of the advancing front various contiguous zones are built up that also are displaced ahead of the combustion front.

These zones may be envisioned as a distillation and cracking zone, a condensation and vaporization zone, an oil bank and a virgin or unaltered zone.

The temperature of the combustion front is generally in the range of 750°–1100° F. The heat generated in this zone is transferred to the distillation and cracking zone ahead of the combustion front where the crude undergoes distillation and cracking. In this zone a sharp thermal gradient exists wherein the temperature drops from the temperature of the combustion front to about 300°–450° F. As the front progresses and the temperature in the formation rises, the heavier molecular weight hydrocarbons of the oil become carbonized. These coke-like materials are deposited on the matrix and are the potential fuel to sustain the progressive in-situ combustion.

Ahead of the distillation and cracking zone is a condensation and vaporization zone. This zone is a thermal plateau and its temperature is in the range of from about 200° F to about 450° F, depending upon the pressure and the distillation characteristics of the fluids therein. These fluids consist of water and steam and hydrocarbon components of the crude.

Ahead of the condensation and vaporization zone is an oil bank which forms as the in-situ combustion progresses and the formation crude is displaced toward the production well. This zone of high oil saturation contains not only reservoir fluids, but also condensate, cracked hydrocarbons and gaseous products of combustion which eventually reach the production well from which they are produced.

Various improvements relating to in-situ combustion are described in the prior art that relate to the injection of water, either simultaneously or intermittently with the oxygen-containing gas, to scavenge the residual heat in the formation behind the combustion front, thereby increasing recovery of oil. Prior art also discloses regulating the amount of water injected so as to improve conformance or sweep efficiency.

Experience has generally shown that these conventional thermal techniques have not been altogether successful when applied to the recovery of heavy oils or bitumen. Where the hydrocarbons sought to be produced have a low API gravity, the build-up of the oil bank ahead of the thermal front occurs to a great extent. Since the heat transfer is low ahead of the front, these heavy hydrocarbons become cool and hence immobile, thereby causing plugging of the formation with the result that the injection of either air in the case of in-situ combustion, or steam in the case of steam, is no longer possible.

The problems recited above become compounded when these techniques are applied to the tar sands not only because of the very low API gravity and very high viscosity of the bitumen, but also because of the very low permeability of the tar sand formations.

Accordingly, it is an object of the present invention to provide an improved thermal recovery method whereby both highly viscous, low gravity crudes and bitumen can be recovered more efficiently. The instant invention accomplishes this recovery of heavy oils and bitumen by utilizing thermal methods wherein a mixture of an oxygen-containing gas and steam is injected having an optimum ratio of gas-to-steam that is controlled in relation to the cumulative amount of steam injected.

SUMMARY OF THE INVENTION

This invention relates to an improved method of recovering low API gravity viscous oils, and more particularly to the production of bitumen from tar sands, by the injection of a mixture of an oxygen-containing gas and steam having an optimum ratio of gas to steam that is decreased as the cumulative amount of steam is increased.

BRIEF DESCRIPTION OF THE FIGURE

The FIGURE shows the relationship between the ratio of the cumulative barrels of steam injected/barrels of oil produced and cumulative air-steam ratio.

DESCRIPTION OF THE PREFERRED EMBODIMENT

We have found that improved recovery of viscous or low API gravity petroleum and bitumen from tar sands, can be obtained by injecting a mixture of an oxygen-containing gas and steam, wherein the ratio of the oxygen-containing gas to steam has an optimum value with respect to the cumulative amount of steam injected.

In the copending and coassigned application, Ser. No. 481,581 filed June 21, 1974, there is described a method for the recovery of heavy oils or bitumens by the injection of a mixture of an oxygen-containing gas and steam at a temperature corresponding to the saturation temperature of steam for the pressure of the formation, whereby low temperature oxidation is established and maintained in-situ in a temperature range of 250°–500° F to enhance the recovery of petroleum.

We have now determined that enhanced recovery utilizing the use of a mixture of an oxygen-containing gas and steam can be improved by controlling the ratio of the oxygen-containing gas to the steam injected. Furthermore, this ratio has an optimum value depending upon the cumulative volumes of fluid injected.

To illustrate this invention, a series of laboratory tests were performed using a tar sand from the McMurray formation in Alberta, Canada. Approximately 190 pounds of tar sand were packed in a cell approximately 15 inches long and 18 inches in diameter. The cell was equipped for operating at controlled temperatures up to 420° F and pressures of 500 psi, and contained simulated suitable injection and production wells. In addition, the cell contained many thermocouples so that both temperatures throughout the cell could be measured and heat transfer rates could be calculated.

The general procedure employed in the test involved the injection of steam to establish fluid communication and to initiate production, after which a mixture of an oxygen-containing gas such as air and steam was injected. The injection pressure was about 300 psi and the temperature was about 417° F, corresponding to the saturation pressure of steam. The accompanying table gives the conditions of the runs and the results.

| Run | Fluids Injected | Time (hr.) | Air/Steam Ratio (MSCF air/bbl steam) | Recovery % |
|---|---|---|---|---|
| 1 | Steam | 30 | — | 31 |
| 2 | Steam and Air | 24 | 0.19 | 62 |
| 3 | Steam and Air | 24 | 0.35 | 35 |
| 4 | Steam and Air | 27 | 0.35 | 47 |
| 5 | Steam and Air | 25 | 0.35 | 47 |
| 6 | Steam and Air | 24 | 0.70 | 39 |

-continued

| Run | Fluids Injected | Time (hr.) | Air/Steam Ratio | Recovery % |
|---|---|---|---|---|
| 7 | Steam and Air | 24 | 1.40 | 41 |

The results are also plotted in the accompanying FIGURE in terms of cumulative barrels of steam injected per barrels of oil produced (bbl/bbl) against the cumulative air-steam ratio (MSCF/bbl), for different cumulative pore volumes of steam injected.

The table shows the recoveries obtained by varying the ratio of the air to the steam injected. The ratio is expressed in terms of thousand cubic feet of air per barrel of steam injected. In the accompanying FIGURE the results are plotted whereby the essence of the invention is demonstrated. The cumulative barrels of steam injected per barrel of oil produced is plotted against the air to steam ratio (MSCF/bbl) for given cumulative pore volumes of steam injected. By pore volumes of steam injected is meant pore volumes of water at 60° F converted to steam at the injected temperature and pressure.

The FIGURE shows that for a given cumulative pore volume of injected steam there is a minimum value for the ratio of cumulative steam injected to oil produced that occurs at a specific air-to-steam ratio. The FIGURE also shows that there is a beneficial effect from the simultaneous injection of air with the steam as evidenced by the lower values of the ratio of the steam injected to oil produced.

Thus, for the most efficient recovery of oil expressed in terms of minimum steam injected per oil produced, there is disclosed a process whereby the air-to-steam ratio is controlled in relation to the pore volumes of cumulative injected steam. Generally as the injection of steam is continued, the air-to-steam ratio should be decreased.

In a broad aspect of the invention a hydrocarbon-bearing formation containing a heavy crude or a tar sand containing bitumen is first traversed by at least one injection well and one production well and fluid communication is established such as by the injection of air or nitrogen. It may be necessary to fracture the formation and/or inject a solvent to obtain adequate transmissibility. Thereafter, a mixture of the oxygen-containing gas and steam is injected, the ratio of the constituents of the mixture being adjusted as the injection of steam, in terms of cumulative pore volumes, is continued.

For example where a mixture of air and steam is injected, at a cumulative pore volume of injected steam of 1, the cumulative air-to-steam ratio should be in the range of about 0.61. As the cumulative pore volume of injected steam increases to 2, the said ratio should be decreased to approximately 0.42, and as the pore volume increases to 4, the said ratio should be decreased to approximately 0.22.

While the temperature of the mixture is preferred to be in the range of 250° to 500° F, this may be realized by repressuring the formation to a pressure corresponding to that temperature of saturated steam in the desired temperature range. For example, the formation may first be repressured to about 300 psi so that the temperature of injected steam and oxygen-containing gas can be in the range of 420° F.

The oxygen-containing gas may be air, or a mixture of oxygen and non-condensible gases such as nitrogen, carbon dioxide or flue gas, or it may be substantially pure oxygen.

In summary, in accordance with this invention, more efficient recovery of heavy oils or bitumen is accomplished by the injection of a mixture of an oxygen-containing gas and steam wherein the ratio of the oxygen-containing gas to steam is controlled and regulated as the cumulative pore volumes of injected steam increase. As the injection of steam continues, the ratio of the gas to steam or the relative concentration of the gas in the injected mixture is decreased, thereby minimizing the cumulative barrels of steam injected per barrel of oil produced.

While the actual air-to-steam ratios may be different for given reservoir conditions of temperature and pressure, and formation characteristics, the desired air-to-steam ratios utilized for pore volumes of steam injected may be determined or estimated from tests performed as described herein for conditions simulating given formations in which the disclosed method may be applied.

In one example after about one pore volume of steam has been injected the ratio of the gas-to-steam in the injected mixture is progressively decreased to a range of from about 0.5–0.7 MSCF/bbl to a range of about 0.2–0.4 MSCF/bbl, when approximately 4 pore volumes of steam have been injected.

We claim:

1. In a method for the recovery of viscous hydrocarbons from a subterranean hydrocarbon-bearing formation, traversed by at least one injection well and at least one production well, and having fluid communication therebetween, wherein a mixture of an oxygen-containing gas and steam is injected via said injection well and hydrocarbons are produced via said production well, said mixture being injected at a temperature corresponding to the saturation temperature for saturated steam at the pressure of said formation whereby a low temperature oxidation is established in said formation, the improvement comprising decreasing the relative concentration of oxygen-containing gas in said mixture during the injection of said mixture.

2. The method of claim 1 wherein said oxygen-containing gas is substantially pure oxygen.

3. The method of claim 1 wherein the oxygen-containing gas is air.

4. The method of claim 1 wherein the oxygen-containing gas comprises oxygen, nitrogen, carbon dioxide, flue gas and mixtures thereof.

5. The method of claim 1 wherein said formation is first repressured to a pressure corresponding to a temperature of saturated steam in the range of 250° F to 500° F.

6. A method of recovery of viscous hydrocarbons from a subterranean hydrocarbon-bearing formation traversed by at least one injection well and at least one production well and having fluid communication therebetween comprising the steps of;

a. injecting into said formation via said injection well a mixture comprising an oxygen-containing gas and steam said mixture being injected at a temperature corresponding to the saturation temperature for saturated steam at the pressure of the formation whereby a low temperature oxidation is established in said formation wherein the ratio of the oxygen-containing gas to steam in said mixture is progressively decreased during the injection of said mixture, b. producing said hydrocarbons via said production well.

7. The method of claim 6 wherein after about one pore volume of steam is injected, said ratio of gas to steam is progressively decreased from a range of from about 0.5 to about 0.7 MSCF/bbl to a range of about 0.2 to 0.4 MSCF/bbl.

8. The method of claim 6 wherein said oxygen-containing gas is substantially pure oxygen.

9. The method of claim 6 wherein the oxygen-containing gas is air.

10. The method of claim 6 wherein the oxygen-containing gas comprises oxygen, nitrogen, carbon dioxide, flue gas and mixtures thereof.

* * * * *